US005557851A

United States Patent [19]

Ortiz

[11] Patent Number: 5,557,851

[45] Date of Patent: Sep. 24, 1996

[54] DYNAMIC FLEXIBLE RAZOR HEAD

[75] Inventor: Ernest A. Ortiz, Cheshire, Conn.

[73] Assignee: Warner-Lambert Company, Morris Plains, N.J.

[21] Appl. No.: 597,534

[22] Filed: Feb. 2, 1996

Related U.S. Application Data

[63] Continuation of Ser. No. 234,740, Apr. 28, 1994, abandoned.

[51] Int. Cl.[6] ..... B26B 21/40

[52] U.S. Cl. ..... 30/50; 30/48

[58] Field of Search ..... 30/47–50, 77, 30/81, 82, 83, 90

[56] References Cited

U.S. PATENT DOCUMENTS

| | | | |
|---|---|---|---|
| Re. 30,913 | 4/1982 | Cartwright et al. . | |
| 4,069,580 | 1/1978 | Cartwright et al. . | |
| 4,409,735 | 10/1983 | Cartwright et al. . | |
| 4,443,939 | 4/1984 | Motta . | |
| 4,854,043 | 8/1989 | Chen . | |
| 4,976,028 | 12/1990 | Chen . | |
| 5,003,694 | 4/1991 | Chen | 30/49 |
| 5,224,267 | 7/1993 | Simms et al. | 30/50 |
| 5,313,706 | 5/1994 | Motta et al. | 30/50 X |
| 5,341,571 | 8/1994 | Prochaska | 30/47 X |
| 5,351,401 | 10/1994 | Werner | 30/50 |

FOREIGN PATENT DOCUMENTS

| | | |
|---|---|---|
| 0045879 | 2/1982 | European Pat. Off. . |
| 0312663 | 4/1989 | European Pat. Off. . |
| 914291 | 6/1991 | South Africa . |
| 8805716 | 8/1988 | WIPO . |
| 9220499 | 11/1992 | WIPO . |
| 9504637 | 2/1995 | WIPO . |

*Primary Examiner*—Douglas D. Watts
*Attorney, Agent, or Firm*—Charles W. Almer

[57] ABSTRACT

Flexible razor heads are provided with at least one pivoting blade which pivots in response to forces encountered during shaving. According to one embodiment, a flexible razor head is provided with at least one blade which pivots in response to forces encountered by a movable guard bar. According to other embodiments, the blades pivot together or independently in response to forces encountered by the blade during shaving.

14 Claims, 4 Drawing Sheets

DYNAMIC FLEXIBLE RAZOR HEAD

This case is a continuation of Ser. No. 08/234,740 filed Apr. 28, 1994 and now abandoned.

The present invention is directed to a flexible razor head, and more particularly, to a flexible razor head with at least one pivoting blade.

BACKGROUND OF THE INVENTION

Technological advances in the design of razor heads have brought flexible razor heads which follow the contours of a surface being shaved in response to forces encountered during shaving. One such flexible razor head is disclosed in U.S. Pat. No. 4,976,028 to Chen. Flexible razor heads have become very popular throughout the world as their design enhances closeness and comfort on shaving surfaces which are not perfectly flat. The flexibility of the razor head provides the advantage of greater surface to blade contact in certain situations.

Other designs have provided razor heads with blades adapted to translate downwardly and/or rearwardly and also to pivot downwardly in response to shaving forces. Such designs have become known as "dynamic razors" in light of the relative movement of a blade edge relative to the supporting structure of the razor head. It has also been disclosed to provide guard bars which move downwardly and/or rearwardly in response to drag forces encountered by the face-engaging elements of the razor. Such dynamic elements purportedly provide a more comfortable shave than traditional razor heads having fixed blades.

One drawback of previously described dynamic shaving systems is their reliance upon rigid, i.e., non-flexing, blades.

Since there are some advantages inherent in both dynamic systems and flexible razor head systems, it would be desirable to provide a razor head which is both flexible and comprises dynamic elements.

SUMMARY OF THE INVENTION

The present invention is directed to a flexible razor head having at least one blade which is capable of flexing and pivoting in response to forces encountered during shaving. According to one embodiment, each of two blades rotate about separate axes in response to forces exerted on a movable guard bar or directly on the blades during shaving.

In an alternative embodiment, two blades pivot in response to forces acting directly upon at least one of the blades.

In a still further embodiment, the blades pivot in response to forces encountered by the blades and the cap of the razor head.

DETAILED DESCRIPTION

The present invention provides razor heads with blades adapted to flex during shaving in order to adapt to the contours of a curved surface being shaved and also to advantageously pivot in response to forces encountered during shaving. As used herein, the term "razor head" includes blade cartridges of the type typically manufactured and sold separately for use with a separate razor, as well as shaving systems wherein the operative face-engaging elements are integrally formed with the handle of the shaving system. One embodiment of the present invention which is illustrated in FIG. 1 comprises a flexible razor head wherein the pivotal movement of two blades is controlled, at least in part, by a movable guard bar.

Figure 1:
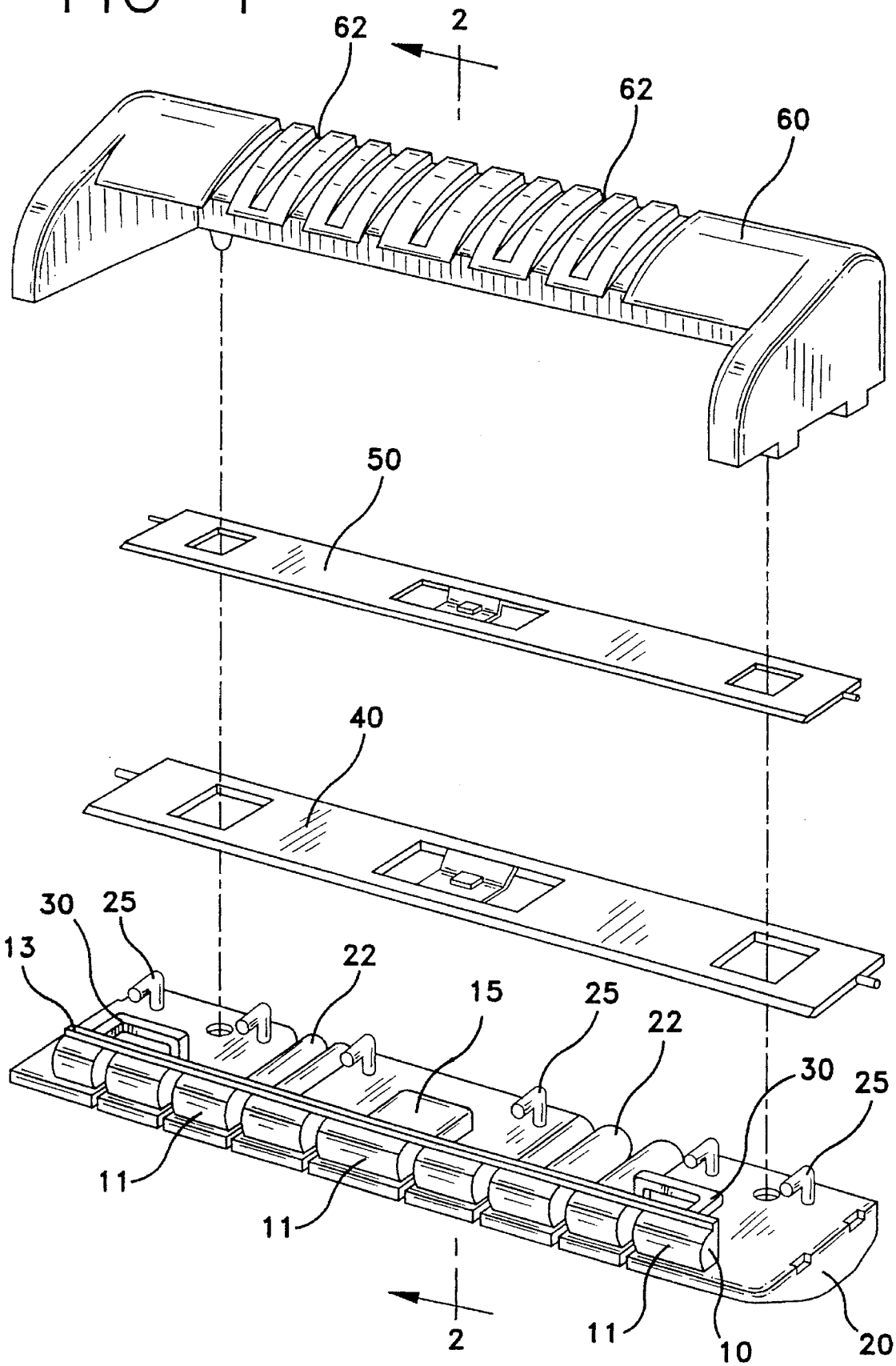
FIG. 1 is an exploded perspective view of one embodiment of the present invention.

With reference to FIG. 1, a dynamic flexible razor head is provided wherein a flexible seat member 20, is connected with a cap 60, a cap blade 50 and a seat blade 40. The seat member 20 comprises a segmented guard bar 10 comprising a plurality of segments 11 which are joined by a skin-flow control bar 13. Skin-flow control bar 13 advantageously extends along the upper portions of individual guard bar segments 11 and effectively joins the guard bar segment 11 into an integral, flexible guard bar 10. Those skilled in the art will also appreciate that skin-flow control bar 13 also advantageously provides greater control of the shaving geometry, particularly in regions between guard bar segments 11. In the absence of some skin-flow control member between individual guard bar segments 11, the skin being shaved may have a tendency to pass at least partially between the individual guard bar segment 11 and, therefore, contact the seat blade 40 at an angle different from skin which had passed over a guard bar segment 11.

Figure 2:
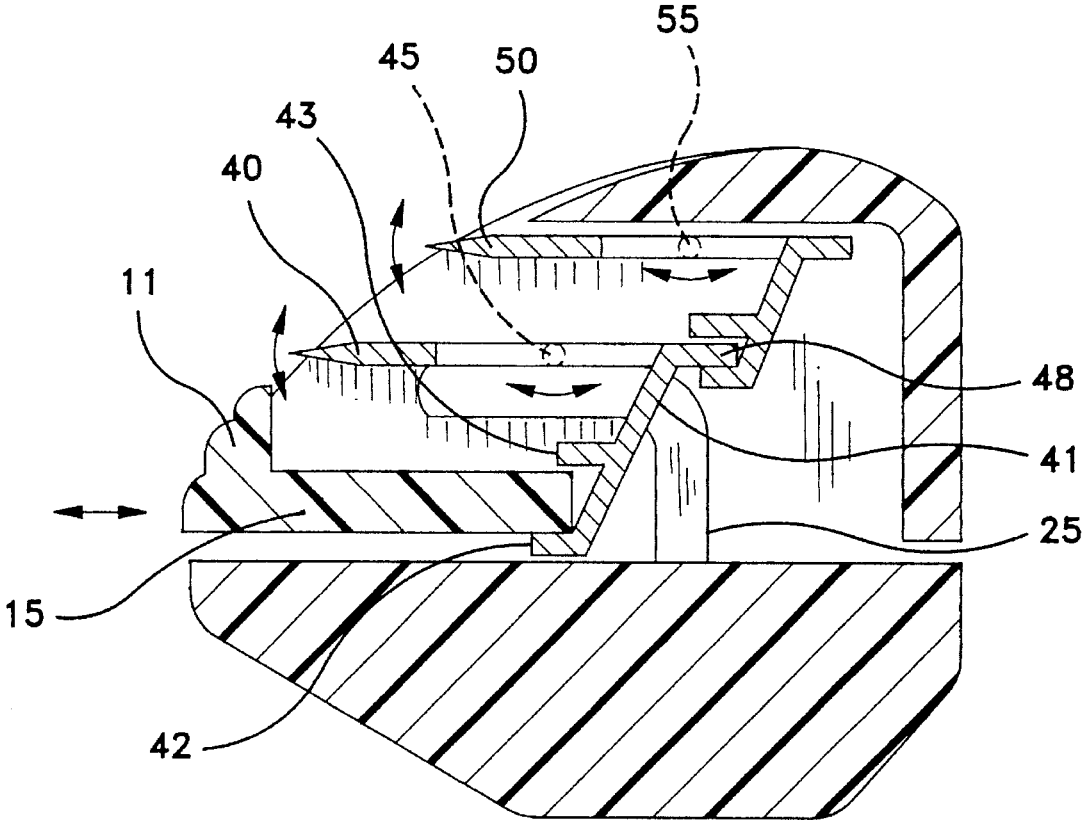
FIG. 2 is a cross-sectional side view taken along lines 2—2 of FIG. 1.
Figure 3:
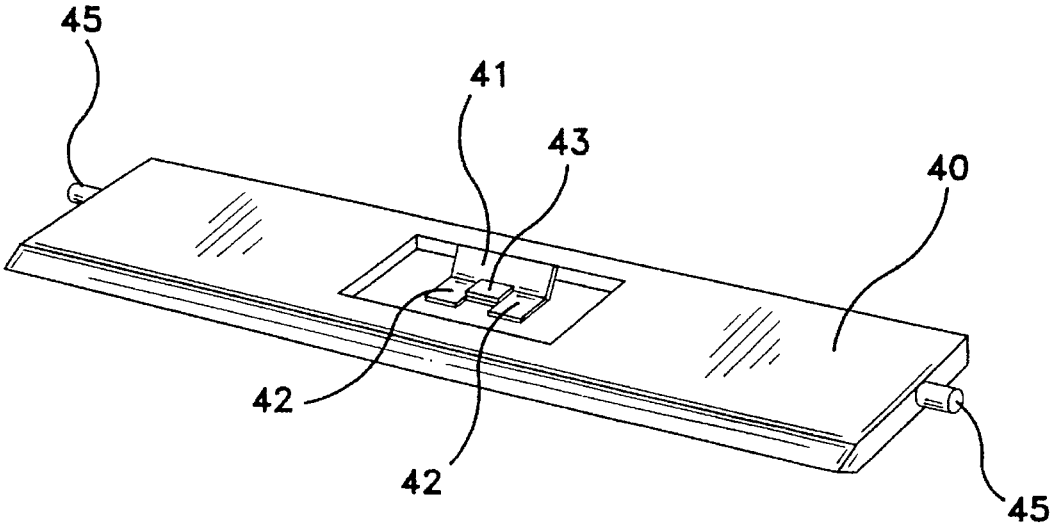
FIG. 3 is a perspective view of a blade utilized in the embodiment illustrated in FIG. 1.

While the embodiment of the present invention illustrated in FIGS. 1–3 comprises a skin-flow control bar 13, alternative designs are possible without departing from the scope of the present invention. For example, instead of a single skin-flow control bar 13 connecting all guard bar segments 11, one or more of the guard bar segments 11 could be individually supported for rearward movement. In such alternative embodiments, at least one of the segments would advantageously be operatively connected to a blade in order to effect blade pivoting. The individual guard bar segments could also alternatively be connected by one or more skin flow control members at other positions, though this might cause some loss in skin flow control.

In a manner now known in the art, base member 20 is advantageously provided with a plurality of corrugated portions 22 which facilitate flexing of the razor head during shaving. Correspondingly, cap 60 is provided with a plurality of relieved sections 62 which facilitate flexing of the cap member. While the illustrated embodiment shown in FIG. 1 is designed to be held together with stakes in a manner known in the art, another preferred manner of forming the non-metallic portions of this razor head is by insert molding.

In the illustrated embodiment, segmented guard bar 10 is attached to flexible base 20 by resilient biasing arms 30. Biasing arms 30 permit guard bar 10 to move rearwardly toward the rear of the razor head in response to drag forces encountered by the guard bar 10 during shaving. When such forces are removed, the inherent resiliency of biasing arms 30 is preferably sufficient to return segmented guard bar 10 to an original, unbiased position best shown in FIG. 2. As illustrated in FIG. 2, when segmented guard bar 10 is in its "home", i.e. forward, position, cap blade 50 and seat blade 40 are substantially parallel to the upper surface a rearwardly extending tongue 15 of guard bar 10. Tongue 15 is positioned to engage a portion of seat blade 40 in a manner described below. Therefore, when segmented guard bar 10 encounters a force sufficient to overcome the forward biasing forces of biasing arms 30, guard bar 10 will move rearwardly and tongue 15 will cause seat blade 40 to pivot about an axis of rotation passing through pivot pins 45. In the embodiment illustrated in FIGS. 1–3, seat blade 40 is also connected to cap blade 50 in a manner which will also cause cap blade 50 to pivot about an axis passing through pivot pins 55.

The manner in which a movable guard bar is connected to a pivoting blade of a flexible razor head can vary within the scope of the present invention. According to the illustrated embodiment shown in FIGS. 2 and 3, seat blade 40 is provided with a downwardly extending lip 41 having two lower, outer shelves 42 and a single upper shelf 43. The bottom surface of upper shelf 43 and the top surfaces of lower shelves 42 provide a slot which engageably receives a rearward portion of tongue 15. The height of the slot formed by upper shelf 43 and lower shelves 42 preferably provides a loose fit for tongue 15. In this manner, rearward movement of guard bar 10 causes seat blade 40 to rotate about the pivoting axis defined by pins 45.

In a similar fashion, cap blade 50 is connected to a rear portion 48 of seat blade 40 such that when seat blade 40 pivots about pivot pins 45, rear portion 48 will be raised causing cap blade 50 to pivot about an axis of rotation defined by pivot pins 55. Pivot pins 45 and 55 of seat blade 40 and cap blade 50, respectively, are sufficiently long that they will not disengage from recesses (not shown) in the sidewalls of the support structure even when the razor head is flexed. From the present description, it will be appreciated by those skilled in the art that this embodiment of the present invention provides a razor head having blades which both flex and pivot in response to forces encountered during shaving.

When the forces which cause the blades to pivot are removed, the blades are restored to their "home" position by resilient biasing fingers 25 which extend upwardly from base member 20 in the illustrated embodiment. As illustrated, biasing fingers 25 also extend forwardly and abut the lower surface of seat blade 40. Biasing fingers 25 are distorted when seat blade 40 is pivoted about pins 45 and, due to their inherent resiliency, biasing fingers 25 restore the seat blade 40 to the "home" position illustrated in FIG. 2 when external forces are removed from the razor head. From the foregoing description, it will be appreciated that the embodiment illustrated in FIGS. 1–3 provides blades which are capable of both flexing and pivoting about their respective rotational axes in response to forces encountered by one or more of the blades and/or the guard bar.

Figure 4:
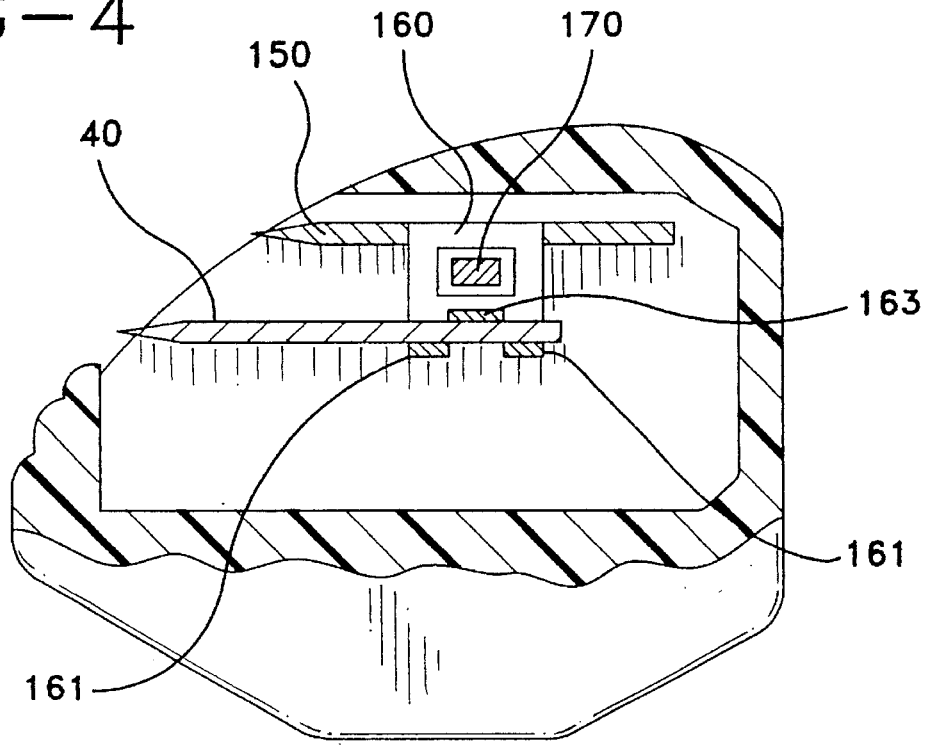
FIG. 4 is a cross-sectional side view of an alternative embodiment of the present invention.
Figure 5:
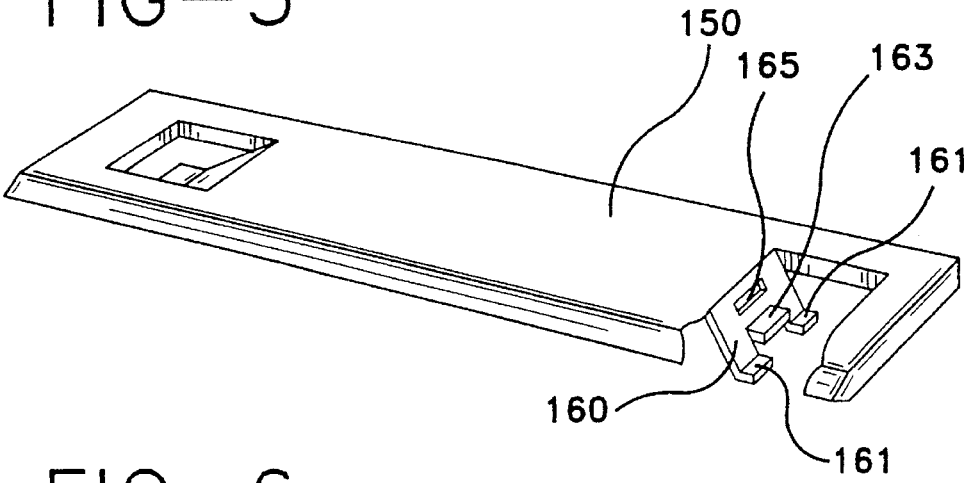
FIG. 5 is a perspective view of the cap blade illustrated in FIG. 4.
Figure 6:
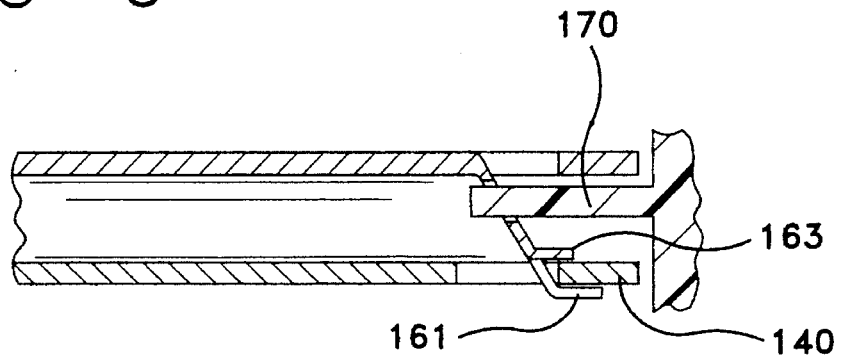
FIG. 6 is a partial, cross-sectional front view of the embodiment illustrated in FIG. 4.

An alternative embodiment of the present invention is illustrated in FIGS. 4–6. According to this embodiment, the blades pivot only in response to forces exerted directly on at least one of the blades during shaving, as opposed to a combination of forces as in the previously described embodiment. The razor head illustrated in FIGS. 4–6 is also a flexible razor head of the general type having corrugations such as those described above or those disclosed in more detail in U.S. Pat. No. 4,976,028 to Chen entitled Flexible Razor Head which is hereby incorporated by reference in its entirety. Though the attachment mechanism for attaching the razor heads described herein to a razor are not illustrated or described in detail, those skilled in the art will appreciate that known razors specifically designed for use with flexible razor heads may be used with any of the illustrated embodiments. In this embodiment of the present invention, the seat blade 140 and cap blade 150 are locked together, preferably in parallel relation, such that forces encountered by one blade which cause that blade to pivot will also be translated to the other blade. In the illustrated embodiment, cap blade 150 is provided with a downwardly extending connecting member 160 having lower shelves 161 and an upper shelf 163. The shelves extend outwardly and are spaced to fit within a recess in seat blade 140 with a portion of seat blade 140 positioned securely between the lower surface of upper shelf 163 and the upper surfaces of lower shelves 161. Connecting member 160 is preferably formed by stamping a conventional blade.

Seat blade 140 and cap blade 150 are pivotally attached to the sidewalls of the flexible razor head by torsion supports 170 which extend inwardly from the sidewalls of the razor head and are received in a recess 165 in connecting member 160. Recess 165 and torsion support 170 are preferably rectangular in order to prevent relative rotation of the blades relative to the torsion support 170. Torsion support 170 provides vertical support to the connected blades while permitting the blades to pivot in response to forces sufficient to twist the inner end portion of torsion support 170. In this manner, the embodiment of the present invention illustrated in FIGS. 4–6 provides a flexible razor head having a pair of connected blades which pivot in response to forces exerted on one or more of the blades during shaving.

Figure 7:
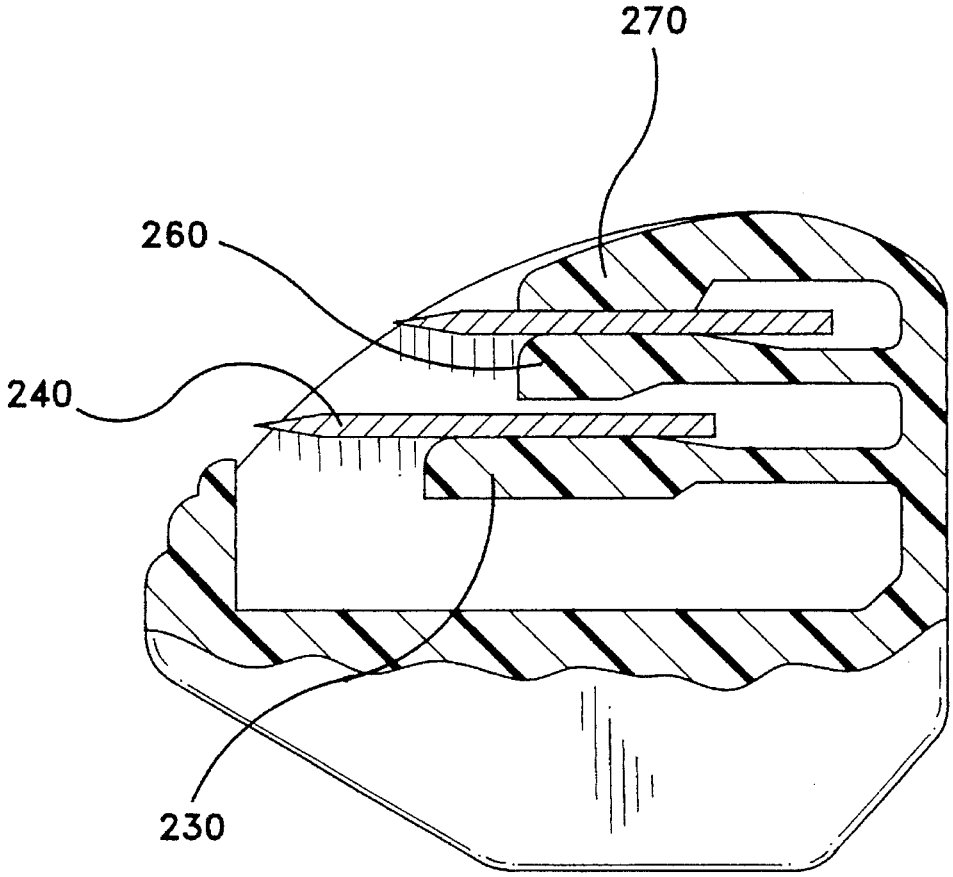
FIG. 7 is a cross-sectional view of another embodiment of the present invention.
Figure 8:
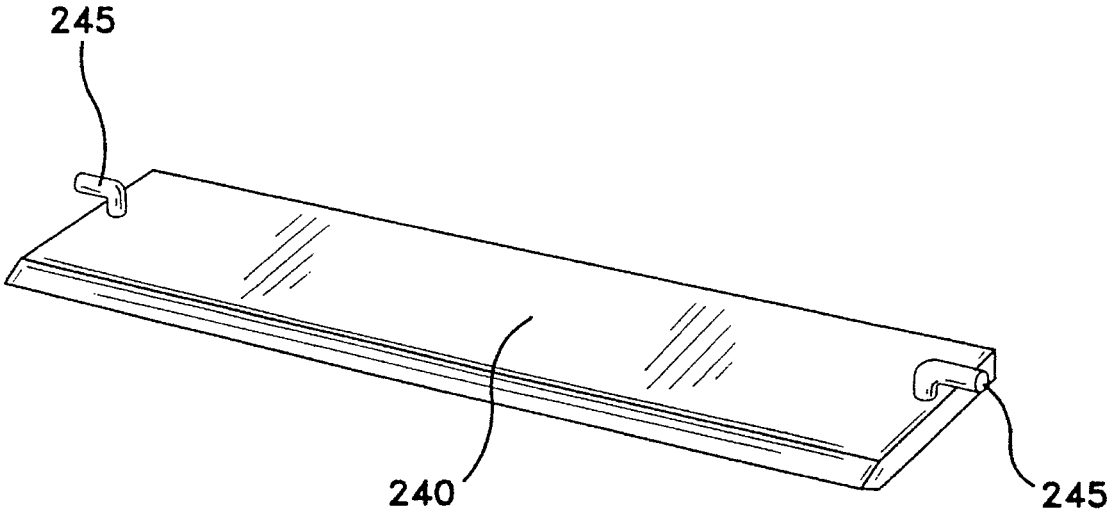
FIG. 8 is a perspective view of a blade utilized in the embodiment illustrated in FIG. 7.

According to a still further embodiment of the present invention illustrated in FIGS. 7 and 8, a pair of blades are substantially independently pivotable in response to forces encountered by the flexible razor head during shaving. According to this illustrated embodiment, each blade is pivotal along an axis passing through pins which are outside the plane of the blade. With reference to FIG. 8, a blade 240 is provided with laterally extending pins 245 designed to be rotatably received within complimentary recesses in the inner sidewalls of the razor head. In order to urge the pivotal blades back to their "home" position, a plurality of biasing fingers extend forwardly from the inner back wall of the blade support. As best shown in FIG. 7, fingers 230 are disposed below seat blade 240 and contact a portion of seat blade 240 forwardly of the pivoting axis defined by pins 245. Biasing fingers 230 are sufficiently resilient to allow blade 240 to pivot in response to forces encountered by the blade during shaving and also to return seat blade 240 the "home" position when the external forces are removed. In a similar fashion, biasing fingers 260 exert an upwardly directed force on cap blade 250 in order to return cap blade 250 to its "home" position. As illustrated in FIG. 7, the cap 270 of the illustrated razor head also contacts cap blade 250 and biases cap blade 250 downwardly if cap blade 250 rotates in a clockwise direction from the home position illustrated in FIG. 7.

While each of the illustrated embodiments of the present invention comprise two blades which are pivotally supported within a flexible razor head, advantages of the present invention may also be attained with a single blade razor head. Those skilled in the art will readily appreciate that each of the illustrated embodiments can be readily adapted to a single blade system.

From the present description and drawings it will be appreciated that the various embodiments of the present invention provide flexible razor heads having blades which pivot in response to forces encountered during shaving. The various embodiments of the present invention are also advantageously designed to provide a close, comfortable shave by providing a razor head which flexes to follow the contours of the surface being shaved.

I claim:

1. A flexible razor head comprising:

a base member;

a movable guard bar comprising a face-engaging portion and a rearwardly-extending tongue, said guard bar having a home position;

means for resiliently connecting said guard bar to said base member whereby said connecting means biases said guard bar toward said home position;

at least one blade pivotally connected to said base member along a pivotal axis, said blade having a home position, whereby said tongue is operatively connected to said blade such that movement of said guard bar causes saod blade to rotate about said pivotal axis; and whereby said base member and said at least one blade are adapted to flex in response to forces encountered during shaving.

2. A flexible razor head according to claim 1 wherein said base member and said connecting means are integrally formed.

3. A flexible razor head according to claim 2 wherein said guard bar is integrally formed with said connecting means.

4. A flexible razor head according to claim 1 wherein said guard bar is integrally formed with said connecting means.

5. A flexible razor head according to claim 1 comprising at least a first blade and a second blade.

6. A flexible razor head according to claim 5 wherein said tongue is operatively connected to said first blade; and said second blade is operatively connected to said first blade.

7. A flexible razor head according to claim 6 wherein at least one of said blades comprises a downwardly extending connecting member.

8. A flexible razor head according to claim 1 further comprising means for biasing said blade to said home position.

9. A flexible razor head according to claim 1 further comprising means for biasing said guard bar to said home position.

10. A flexible razor head according to claim 1 wherein said seat member is integrally formed with said guard bar.

11. A flexible razor head according to claim 10 comprising a cap member integrally formed with said seat member.

12. A flexible razor head comprising:

a support structure comprising a base; and at least a first blade and a second blade pivotally connected to said support;

wherein said support structure, said base and said at least first blade and second blade are adapted to flex in response to forces encountered during shaving and wherein said first blade and second blade are operatively connected such that movement of either blade will cause movement of said other blade.

13. A flexible razor head according to claim 12, comprising at least a first blade and a second blade which are independently movable in response to forces encountered during shaving, wherein each of said blades has a home position, said razor head further comprising means for biasing each of said blades to said respective home position of said blades, and wherein said biasing means comprise resilient biasing fingers.

14. A flexible razor head according to claim 13 wherein said biasing fingers are integrally formed with said support structure.

* * * * *